US005168809A

United States Patent [19]

Becker

[11] Patent Number: 5,168,809

[45] Date of Patent: Dec. 8, 1992

[54] TURNING DEVICE FOR A SHEET-FED ROTARY OFFSET PRINTING PRESS FOR FIRST FORM AND PERFECTOR PRINTING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 828,717

[22] Filed: Jan. 31, 1992

[30] Foreign Application Priority Data

Feb. 4, 1991 [DE] Fed. Rep. of Germany ..... 4103296

[51] Int. Cl.[5] ..... B41F 1/30

[52] U.S. Cl. ..... 101/408; 101/230; 101/246; 271/82; 271/277

[58] Field of Search ..... 101/408, 409, 410, 411, 101/216, 217, 229, 230, 231, 232, 246; 271/82, 277

[56] References Cited

U.S. PATENT DOCUMENTS

| | | | |
|---|---|---|---|
| 2,442,839 | 6/1948 | Carlson | 101/408 |
| 4,026,209 | 5/1977 | Becker et al. | 101/231 |
| 4,029,009 | 2/1977 | Kuhn et al. | 101/231 |
| 4,204,471 | 5/1980 | Becker | 101/410 |
| 4,210.079 | 7/1980 | Raes | 101/217 |
| 4,378,734 | 4/1983 | Wirz | 101/230 |
| 4,621,576 | 11/1986 | Wirz | 101/230 |
| 4,667,952 | 5/1987 | Jeschke et al. | 271/277 |
| 4,815,379 | 3/1989 | Becker | 101/246 |

FOREIGN PATENT DOCUMENTS 8415129 12/1985 Fed. Rep. of Germany .

*Primary Examiner*—Eugene H. Eickholt

*Attorney, Agent, or Firm*—Werbert L. Lerner; Laurence A. Greenberg

[57] ABSTRACT

A turning device for a sheet-fed rotary offset printing press for first form and perfector printing having a storage drum disposed between a turning drum and a transfer drum, the storage drum having a diameter triple that of the respective turning and transfer drums, comprising a sheet run-up lock disposed at the storage drum before a sheet transfer point between the transfer drum and the storage drum, and projecting into a travel path of a sheet having an improperly gripped at its trailing edge; and device for performing the method.

7 Claims, 3 Drawing Sheets

TURNING DEVICE FOR A SHEET-FED ROTARY OFFSET PRINTING PRESS FOR FIRST FORM AND PERFECTOR PRINTING

The invention relates to a turning device for a sheet-fed rotary offset printing machine for first form and perfector printing having a storage drum disposed between a turning drum and a transfer drum, the storage drum having a diameter triple that of the respective turning and transfer drums.

Such a turning device between two printing units or between a finishing unit and a printing unit has become known heretofore, for example, from the German Utility Model 84 15 129. During normal operation, the sheet arriving from the preceding finishing unit and printing unit, respectively, is gripped by leading-edge grippers at a transfer point between a transfer drum and a storage drum and retained at the storage drum. At the sheet-transfer point between the storage drum and the turning drum, the sheet to be turned passes the transfer point first and continues until the trailing edge of the sheet reaches the transfer point, and tongs grippers grip the trailing edge of the sheet and convey the just-turned sheet to the following printing unit via the turning drum. The instant the tongs grippers of the turning drum grip the trailing edge of the sheet, the leading-edge grippers of the storage drum release the sheet.

When perfecting, it has been found, in practice, however, that a feed pile is formed with a number of sheets which are too short and thus are not gripped by the tongs grippers at the transfer point between the storage drum and the turning drum. During normal operation and at press speeds which are not too high, these sheets get lost below the storage drum following the opening of the leading-edge grippers. Depending upon the adherence of the sheets to the storage drum and especially at high machine speeds, time for the sheets to fall off the storage drum is insufficient. In such cases, the short sheet travels back into the press in an uncontrolled manner and collides with the following sheet which has previously arrived at the transfer point. This may cause paper jams and may possibly damage the blankets. Rather lengthy interruptions of operation result therefrom.

It is accordingly an object of the invention to provide a turning device of the foregoing general type which prevents the run-up or re-entry of a short sheet into the press.

With the foregoing and other objects in view, there is provided, in accordance with the invention, a turning device for a sheet-fed rotary offset printing press for first form and perfector printing having a storage drum disposed between a turning drum and a transfer drum, the storage drum having a diameter triple that of the respective turning and transfer drums, comprising a sheet run-up lock disposed at the storage drum before a sheet transfer point between the transfer drum and the storage drum, and projecting into a travel path of a sheet having an improperly gripped trailing edge.

This sheet run-up lock prevents each sheet, which is not gripped or is improperly gripped by the tongs grippers at the trailing edge of the sheet and which has not fallen off the storage drum, from abutting by its leading edge against the sheet run-up lock and thus from re-entering the press. The short sheet is thereby forcibly loosened or released from the storage drum and disappears below the storage drum.

In accordance with another feature of the invention, the sheet run-up lock is fixed to the printing press and is finger-shaped, with a free end thereof engageable in a circumferential free groove formed in the storage drum. The tip of the finger-shaped structured thus projects diametrically into the storage drum.

In accordance with a further feature of the invention, the sheet run-up lock is formed with stripping fingers having finger tips engageable in free grooves formed circumferentially in the storage drum. Moreover, the stripping fingers are mutually spaced apart and are fixed to the printing press. It is further noted that the gripper bridges and the suction devices must also be formed with such free grooves.

More specifically, in accordance with an added feature of the invention, the stripping fingers are exchangeably fastened to a support fixed to the printing press.

In accordance with an additional feature of the invention, there is provided a sheet guiding device disposed below the sheet run-up lock and formed with a sheet-catching surface having an upward inclination in rotational direction of the storage drum and having a limiting stop at an upper edge thereof. The sheet-guiding device catches the sheet forcibly stripped from the storage drum and ensures that the sheet is diverted downwardly in the opposite direction.

In accordance with yet another feature of the invention, the sheet-guiding device has a lower end disposed in vicinity of an opening formed in a support for the printing press. The short sheet consequently falls from the sheet-guiding device through the opening formed in the press support and is removable below the support.

In accordance with a concomitant feature of the invention, the turning device includes means for adjustably varying the inclination of the sheet-catching surface of the sheet-guiding device. With this feature, the turning device may be adapted for use with different paper qualities at different machine speeds.

Other features which are considered as characteristic for the invention are set forth in the appended claims.

Although the invention is illustrated and described herein as embodied in a turning device for a sheet-fed rotary offset printing press for first form and perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
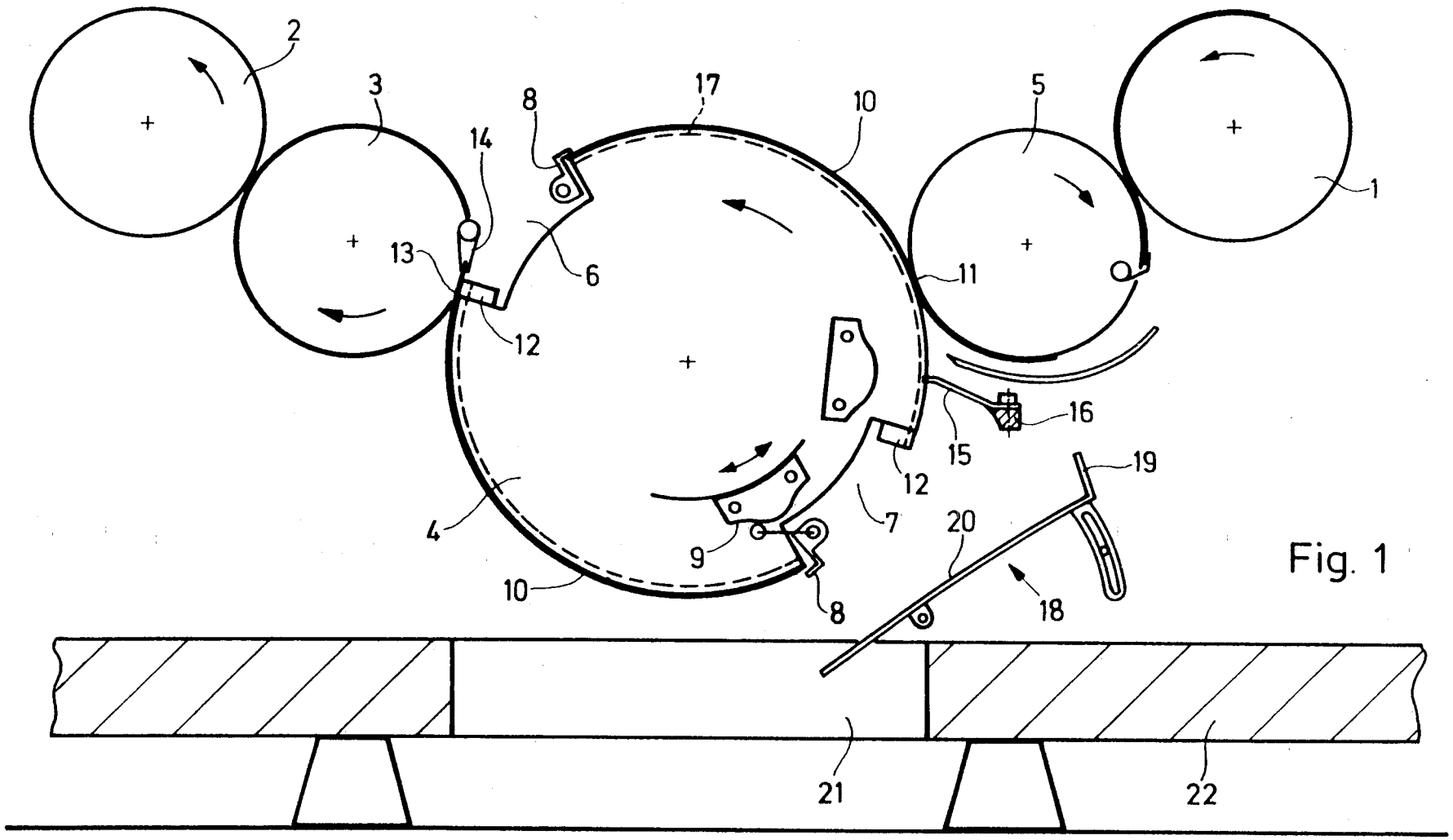
FIG. 1 is a diagrammatic side elevational view of a turning device between two impression cylinders of different printing units processing a sheet of standard length.
Figure 2:
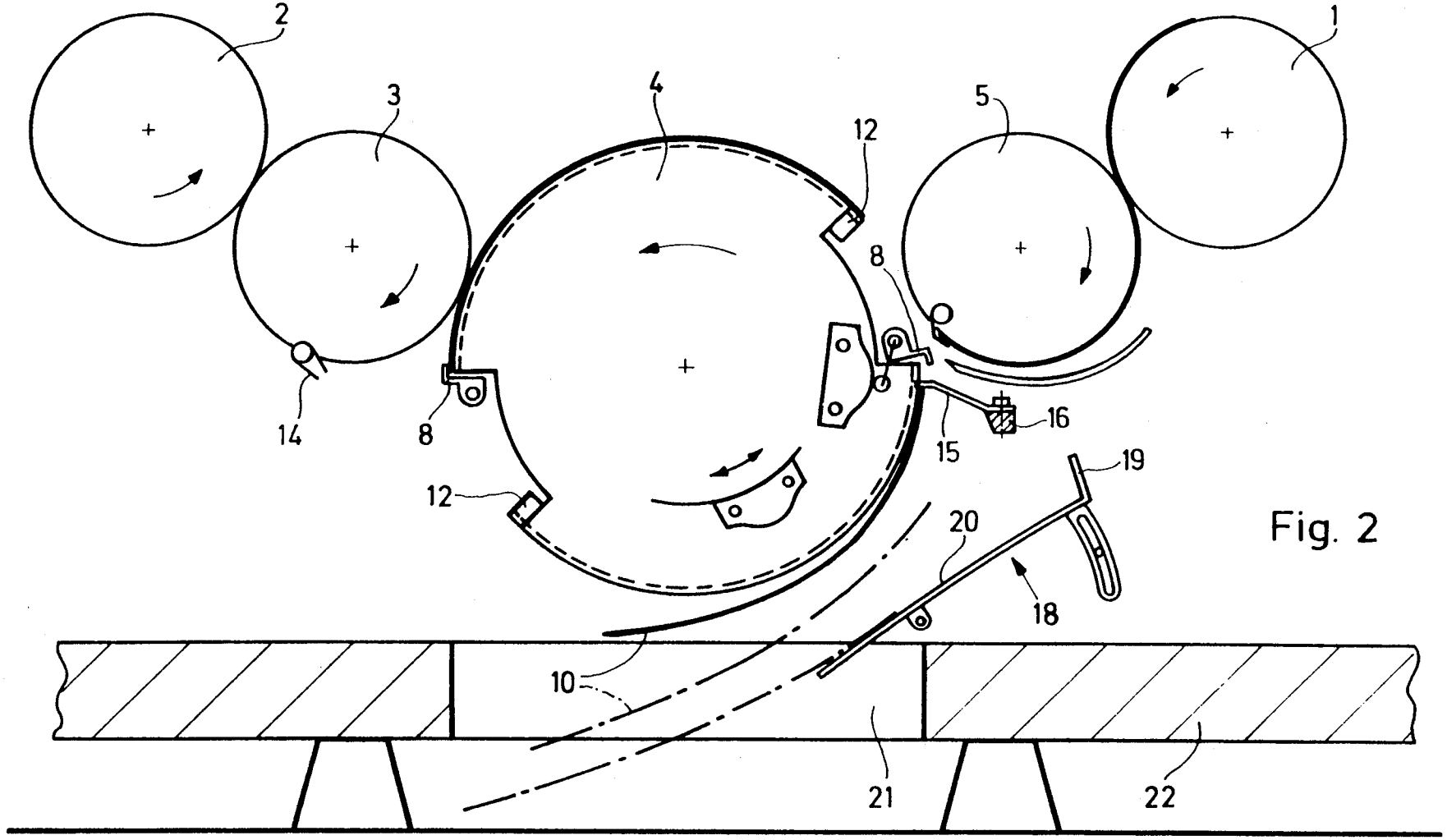
FIG. 2 is another view of FIG. 1 wherein the turning device is processing a sheet having a length which is shorter than the standard length.
Figure 3:
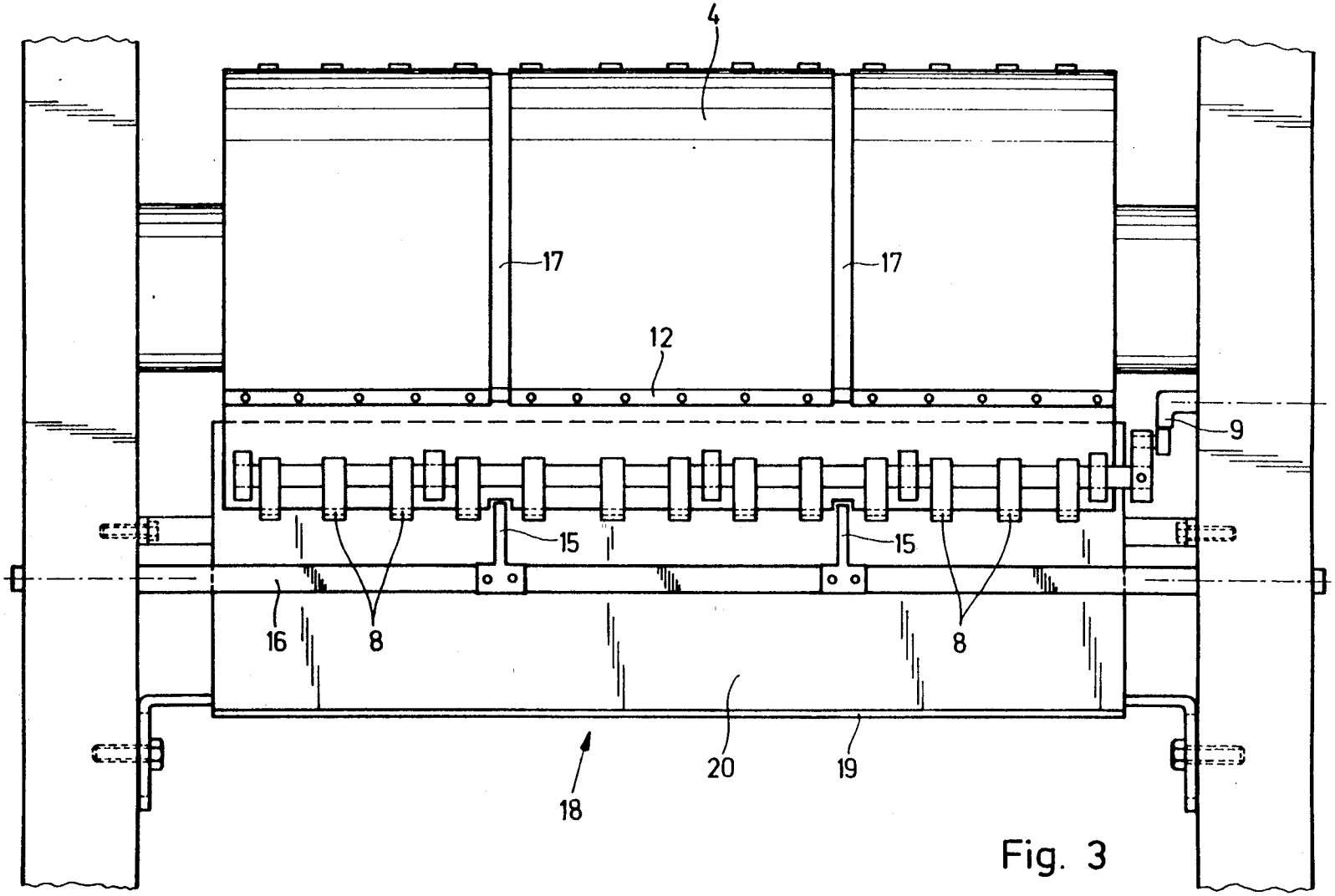
FIG. 3 is a top plan view of a storage drum with a sheet run-up lock forming part of the invention.

Referring now to the figures of the drawing, there is shown therein, between impression cylinders 1 and 2 of two successive printing units, a turning device made up of a turning drum 3, a storage drum 4 and a transfer drum 5. The storage drum 4 disposed between the transfer drum 5 and the turning drum 3 has a double-sized diameter, i.e. a diameter twice that of the impression cylinder 1 or 2, and two sheet-supporting areas on the outer cylindrical surface thereof. Gripper bridges having grippers 8 for gripping a leading edge of a sheet are movably mounted in axial channels or slots 6 and 7 formed in the storage drum 4. The motion of the grippers 8 for gripping a leading edge of a sheet is controlled by means of cams 9. At a transfer point 1, the transfer drum 5 transfers a sheet 10 coming from a first printing unit to the storage drum 4 which holds the sheet 10 at the leading edge thereof by means of the grippers 8. If necessary or desirable, the trailing edge of the sheet 10 is sucked against the outer cylindrical surface of the storage drum 4 by means of sucking devices 12. With the turning device activated, the leading edge of the sheet 10 passes a transfer point 13 between the storage drum 4 and the turning drum 3, and the sheet 10 deposits on the turning drum 3 until the trailing edge of the sheet 10 reaches the transfer point 13 and is gripped by tongs or pincer grippers 14 arranged on the turning drum 3. Simultaneously, the leading edge grippers 8 open and release the sheet 10 so that the sheet 10 which has thereby been turned can be conveyed via the turning drum 3 to the following printing unit.

In order to prevent sheets, which are too short and which have not been gripped by the tongs grippers 14 and have not been released from the storage drum 4, from running up, a sheet run-up lock is provided before the transfer point 11 between the transfer drum 5 and the storage drum 4 in the region defined within the angle between the location at which the leading edge grippers 8 open and the transfer point 11. In the illustrated embodiment, this sheet run-up lock is formed of a plurality of fingers 15 which are mutually spaced apart and exchangeably attached to a support 16 fixed to the printing press. The embodiment has two fingers 15 having finger tips which engage in free grooves 17 formed at the circumference of the storage drum 4, the gripper bridges 8 and the sucking devices 12 being formed with corresponding free grooves 17. The tips of the fingers 15 thus extend diametrically into the free grooves 17 formed in the storage drum 4 so that the arriving short sheet abuts against the fingers 15 and is forcibly loosened or released from the storage drum 4. In the illustrated embodiment, a sheet-guiding device 18 formed with a catching surface 20 which is inclined upwardly in the sheet-travel direction is disposed below the sheet run-up lock formed of the fingers 15, the upper end of the catching surface 20 being limited by a stop 19. The lower end of the sheet-guiding device 18 lies in the vicinity of an opening 21 formed in a support 22 for the printing press so that, via the guiding device 18, short sheets 10 coming off the storage drum 4 are diverted through the opening 21 and may be removed below the press support 22. The inclination of the guiding device 18 is advantageously adjustable, thereby ensuring the adaptability thereof to different operating conditions.

The foregoing is a description corresponding in substance to German Application P 41 03 296.9, dated Feb. 4, 1991, the International priority of which is being claimed for the instant application, and which is hereby made part of this application. Any material discrepancies between the foregoing specification and the aforementioned corresponding German application are to be resolved in favor of the latter.

I claim:

1. Turning device for a sheet-fed rotary offset printing press for first form and perfector printing having a storage drum disposed between a turning drum and a transfer drum, the storage drum having a diameter triple that of the respective turning and transfer drums, comprising a sheet run-up lock disposed at the storage drum before a sheet transfer point between the transfer drum and the storage drum, and projecting into a travel path of a sheet having an improperly gripped trailing edge.

2. Turning device according to claim 1, wherein said sheet run-up lock is fixed to the printing press and is finger-shaped, with a free end thereof engageable in a circumferential free groove formed in the storage drum.

3. Turning drum according to claim 1, wherein said sheet run-up lock is formed with stripping fingers having finger tips engageable in free grooves formed circumferentially in the storage drum.

4. Turning device according to claim 3, wherein said stripping fingers are exchangeably fastened to a support fixed to the printing press.

5. Turning device according to claim 1, including a sheet guiding device disposed below said sheet run-up lock and formed with a sheet-catching surface having an upward inclination in rotational direction of the storage drum and having a limiting stop at an upper edge thereof.

6. Turning device according to claim 5, wherein said sheet-guiding device has a lower end disposed in vicinity of an opening formed in a support for the printing press.

7. Turning device according to claim 5, including means for adjustably varying said inclination of said sheet-catching surface of said sheet-guiding device.

* * * * *